United States Patent [19]

Reyner et al.

[11] 4,148,388

[45] Apr. 10, 1979

[54] TESTING APPARATUS FOR NON-CIRCULAR COINS

[75] Inventors: Peter J. Reyner, Northwood; Patrick A. Henehan, Bracknell, both of England

[73] Assignee: Mars, Inc., McLean, Va.

[21] Appl. No.: 734,723

[22] Filed: Oct. 22, 1976

[30] Foreign Application Priority Data

Jan. 9, 1976 [GB] United Kingdom ..... 875/76

[51] Int. Cl.[2] ..... G07F 3/02

[52] U.S. Cl. ..... 194/102; 194/97 A

[58] Field of Search ..... 194/97 R, 97 A, 98, 194/99, 100 R, 100 A, 101, 102, 4 F, 4 G

[56] References Cited

U.S. PATENT DOCUMENTS 3,797,628 3/1974 Fougere et al. ..... 194/99

FOREIGN PATENT DOCUMENTS 1403103 8/1975 United Kingdom ..... 194/100 A

*Primary Examiner*—Robert J. Spar
*Assistant Examiner*—Francis J. Bartuska
*Attorney, Agent, or Firm*—Davis, Hoxie, Faithfull & Hapgood

[57] ABSTRACT

A coin testing apparatus for identifying non-circular coins of a particular denomination. The apparatus includes an array of coin presence sensors. Two reference sensors are located along a line perpendicular to the coin track equidistant above and below a line parallel to the track and approximately half the coin's mean diameter above the track. Two secondary sensors are located along the line parallel to the track so that when a coin of the said denomination first occludes one or other of the reference sensors it occludes one but not both of the secondary sensors. Other sensors are provided to indicate that the coin is non-circular.

9 Claims, 6 Drawing Figures

TESTING APPARATUS FOR NON-CIRCULAR COINS

The present invention relates to a coin testing apparatus and particularly an apparatus for identifying non-circular coins.

In the specification of U.K. Patent No. 1,296,484 there is described an apparatus for identifying coins in which the diameter of the coin is examined by passing the coin along a track in front of an array of coin-presence sensors. The array includes a reference sensor and a pair of secondary sensors for each denomination of coin to be identified. The spacing of the secondary sensors from the reference sensor is such that an acceptable coin of the donomination will concurrently cover the reference sensor and one of the secondary sensors but not the other.

With a coin of non-circular shape such as the British 50 pence piece an arrangement of a reference sensor and a pair of secondary sensors cannot be used to test coin size to close tolerances. The dimension measured along a particular line fixed in relation to the coin track will vary according to the attitude of the coin on the track, so that the spacing of the secondary sensors would have to be large enough to accept geniune coins irrespective of the attitudes at which they present themselves to the sensor array.

In one aspect the present invention is concerned to provide an arrangement for testing coins of a non-circular shape which enables the coin's dimensions to be tested to closer tolerances than with an arrangement as described above.

In another aspect the present invention provides an apparatus for testing coins which can distinguish between a circular and a non-circular coin of substantially the same size.

An embodiment of the invention will now be described, by way of example, with reference to the accompanying drawings, in which.

Figure 1:
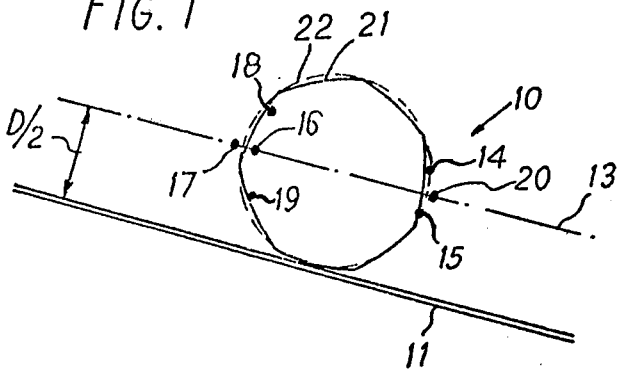
FIG. 1 shows a coin passageway with a coin sensor array of an apparatus for identifying a 50 pence piece.

Referring to the drawings these show an apparatus for identifying a Britsh 50 pence piece which is a non-circular coin having seven arcuate sides. FIG. 1 shows a coin passageway 10 with an inclined coin-supporting track 11 along which coins can roll. Above the track in the side of the passageway is an array of coin presence sensors. The sensors are photoelectric devices with associated light sources in the opposite side of the coin passageway, the presence of a coin being detected when the light beam from a light source falling on its associated sensor is interrupted.

In the drawing the chain dotted line 13 indicates a height of approximately D/2 above the coin track, where D is the diameter of the 50 pence piece.

At the downstream end of the sensor array two reference sensors 14 and 15 are disposed above and below the line 13 at the same longitudinal position along the passageway. The sensors 14 and 15 are equidistant from the line 13 and spaced from it by a distance of approximately D/10. At the upstream end of the array and at a height of D/2 above the coin track 11 are two secondary sensors 16 and 17 which are spaced from the sensors 14 and 15 by distances slightly less than D and slightly greater than D respectively.

Slightly downstream of the sensors 16 and 17 above and below the line 13 and at the same longitudinal position to one another are two sensors 18 and 19. The sensors 18 and 19 are equidistant from the line 13 and spaced from it by a distance of approximately D/4. The position of the sensors 18 and 19 are such that a circular coin of a diameter such that it can concurrently obscure sensor 14 or 15 and sensor 16 and leave 17 unobscured, will obscure both sensors 18 and 19 when first it concurrently obscures sensors 14 and 15. On the other hand a 50 pence piece will not obscure both sensors 18 and 19 when first it obscures sensors 14 and 15 except in the special case where the coin arrives at the sensors 14 and 15 with a corner approximately midway between two sensors.

Slightly downstream of the sensors 14 and 15 and at a height of D/2 above the track 11 is a sensor 20. The positions of the sensor 20 is such that it lies outside a circle passing through the sensors 14, 15, 18 and 19 but such that it is covered by a 50 pence coin the leading edge of which just covers the sensors 14 and 15 and has a corner disposed approximately midway between the sensors 14 and 15.

The sensor array performs two tests as follows. As a 50 pence coin 21 rolls down the track 11 it will pass the sensors 17, 16, 18 and 19. Depending upon its attitude it may reach sensor 14 before or after it reaches the sensor 15. When it reaches one or other of the sensors 14 or 15 the first test is performed. The position of the trailing edge of the coin in relation to the sensors 16 and 17 is examined and if the sensor 16 is obscured and the sensor 17 is not the coin will have the "circular" dimensions of a genuine 50 pence coin. By using two reference sensors which in the test position of the coin are spaced around the periphery of the coin by a fraction of the length of one side of the coin the effects of the angular attitude of the coin in the test position are reduced. This means that the spacing of sensors 16 and 17 can be made small to define the dimension of the coin within close tolerances without causing the apparatus to reject genuine coins which present themselves at the test position in an unfavourable attitude.

The second test detects whether the coin is non-circular since the first test could be passed by a circular coin of appropriate diameter. In the second test the position of the coin in relation to the sensors 18, 19 and 20 is examined when the leading edge of the coin first obscures both of the sensors 14 and 15. A circular coin 22 (shown in broken line) that passes the first test will simultaneously occlude both the sensors 18 and 19 when first it occludes sensors 14 and 15. However a 50 pence piece because of its somewhat flattened sides will not obscure both sensors 18 and 19 simultaneously to the first occlusion of sensor 14 and 15 except in the special case where one of the corners is disposed approximately midway between the sensors 14 and 15, i.e. a diameter from the mid point of one side to the opposite corner of the coin lies on the line 13. Thus except in the special case mentioned, the presence of a non-circular coin will be detected by the fact that when the sensors 14 and 15 are first occluded, either or both of sensors 18 and 19 is not occluded. To detect the presence of a non-circular coin presenting itself in the special case, the sensor 20 is provided. This sensor will be obscured by the corner of the 50 pence coin in the attitude of the special case when the sensors 14 and 15 are first obscured but will not be obscured by a circular coin passing the first test as can be seen from FIG. 1.

Figure 2:
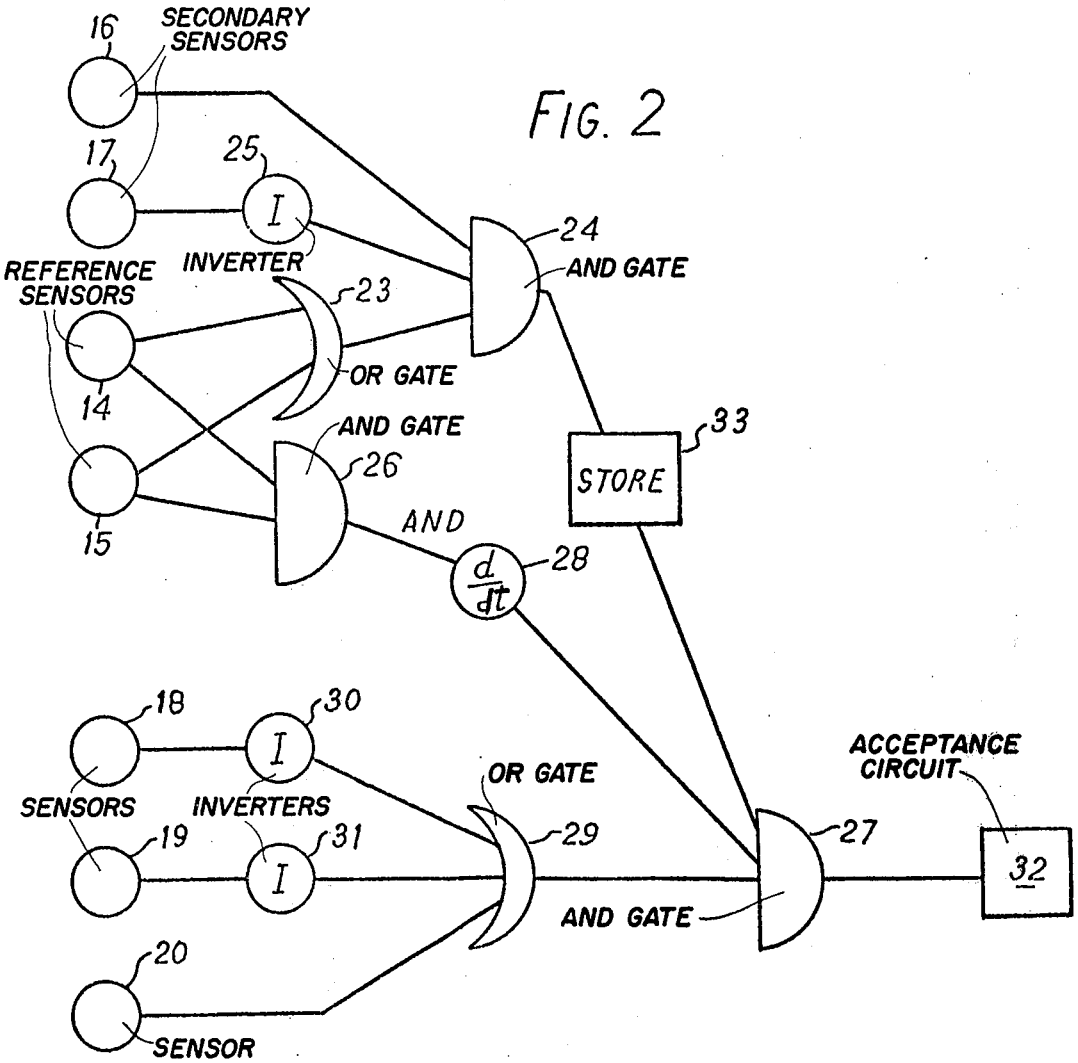
FIG. 2 shows a logic diagram of the circuit of the apparatus of FIG. 1.
Figure 3A:
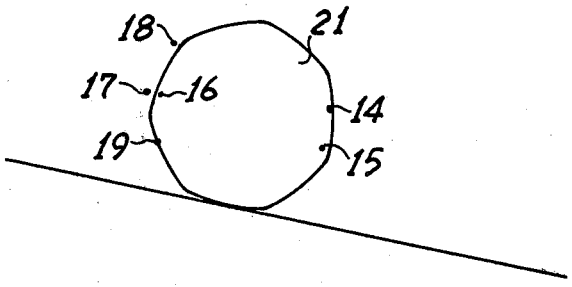
FIGS. 3A through 3D illustrate a British 50 pence coin in various attitudes when the edge of the coin first passes both of the reference sensors 14 and 15.
Figure 3B:
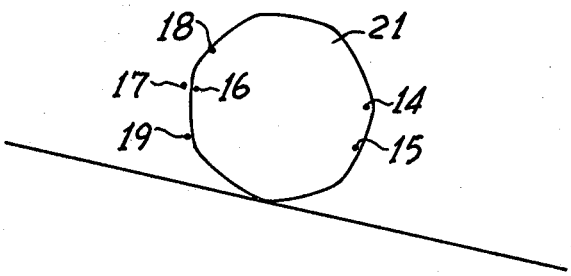
Figure 3C:
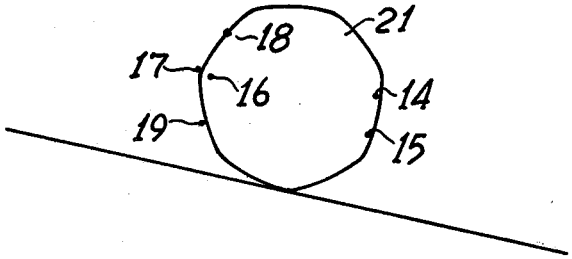
Figure 3D:
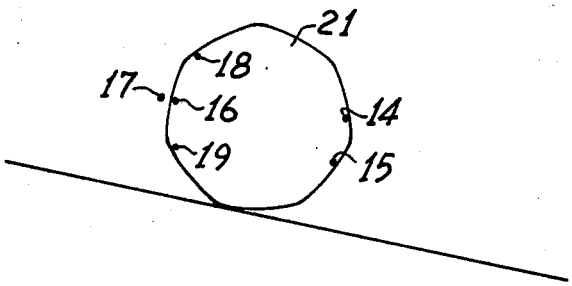

The logic circuitry that might be used for the coin testing apparatus employing the sensor array of FIG. 1 is shown in FIG. 2.

The sensors 14 and 15 are connected to an OR gate 23, the output of which is connected to one of three inputs of an AND gate 24. The other two inputs of the AND gate 24 are connected to the sensor 16 and through an inverter 25 to the sensor 17.

The sensors 14 and 15 are also connected to an AND gate 26, the output of which is fed to an AND gate 27 through a differentiating circuit 28 so that the gate 27 is enabled for a short period only at the leading edge of the signal from the gate 26. The gate 27 has two other inputs, one is connected to the output of the gate 24 via a temporary store 33 (which may be provided by a capacitor) and the other is connected to the outpt of an OR gate 29. The OR gate 29 has three inputs connected respectively to the sensor 18 through an inverter 30, to the sensor 19 through an inverter 31 and to the sensor 20. The output of the AND gate 27 indicates whether the coin is acceptable and is connected to the accumulator, and acceptance circuits 32.

The circuit operates as follows. When a coin is inserted in the coin mechanism it passes along the passageway until it reaches one or other of the sensors 14 and 15. Occlusion of one or other of these sensors causes the OR gate 23 to give an output which enables the AND gate 24. Provided that the coin is of the appropriate dimensions to obscure the sensor 16 and not obscure the sensor 17 the AND gate 24 will receive enabling signals on all three of its inputs and will pass an enabling signal to the input of the AND gate 27 indicating that the first test has been passed.

When the coin has moved a little further down the passageway both sensors 14 and 15 will be obscured giving enabling signals on both inputs to the AND gate 26 which will give an output signal, the leading edge of which will enable the AND gate 27. If the first test has been passed the input to the AND gate 27 from the AND gate 24 (via the temporary store 33) will be enabled. The third input to the AND gate 27 will be enabled if either of the sensors 18 or 19 is not obscured or if sensor 20 is obscured since any of these conditions causes the OR gate 29 to give an enabling output to the gate 27. Thus if the coin is of a size to pass the first test, it will pass the second test when it first occludes both the sensors 14 and 15 either it does not occlude sensor 18 or 19 or it occludes the sensor 20. A circular coin of the right size to pass the first test will not satisfy this condition because it will occlude both of the sensors 18 and 19 when the sensors 14 and 15 are first both occluded and not occlude sensor 20 at this instant.

It will be appreciated that the invention may be used to identify non-circular coins other than the British 50 pence piece, the relative positions of the sensors being varied according to the shape and size of the coins. It will also be appreciated that as an alternative to having two reference sensors, two sets of secondary sensors spaced around the periphery of the coin in the test position, may be provided. As an alternative to using a pair of secondary sensors with a reference sensor, the invention may be applied to an arrangement in which only one secondary sensor is used and the duration of concurrent occlusion of the reference and secondary sensors is examined to see if it falls within a predetermined tolerance range as in the embodiment of FIGS. 6 and 7 of British patent specification 1,272,560, published May 3, 1972, two reference sensors or two such secondary sensors being used. Although in the embodiment described the sensors 14 and 15 are arranged equidistant from and on opposite sides of the line D/2 above the track, alternative arrangements are possible in which the reference sensors lie on opposite sides of a radius which makes an angle to the track. Similarly the secondary sensors may be at other positions around the periphery of the coin in the test position.

The testing apparatus according to the invention may be used in conjunction with other coin testing apparatus such as the conductivity testing apparatus described in the aforementioned patent.

We claim:

1. An apparatus for testing non-circular multi-sided coins of a particular denomination comprising:

a coin passageway;

a coin track defining a coin path along the coin passageway;

a test position on the coin track;

means for examining a coin at the test position comprising an array of coin sensors and including:

a first reference sensor and at least one secondary sensor spaced along a first line predetermined relative to the test station;

a second reference sensor and at least one secondary sensor spaced along a second line predetermined relative to the test position, one sensor of one line being spaced circumferentially relative to a coin at the test position from one sensor of the other line by a fraction of the side length of the predetermined coin;

first means initiated responsive to the first reference sensor for comparing the dimension of a coin at the test position against the sensors of the first line when an edge of the coin passes the first reference sensor;

second means initiated responsive to the second reference sensor for comparing the dimension of the coin at the test position against the sensors of the second line when an edge of the coin passes the second reference sensor and at substantially the same time as the comparision by the first means for comparing, the examining means issuing an acceptance signal if either one of the comparing means determines the dimension of the coin along the corresponding line to be equal to the dimension of a genuine coin to within a predetermined tolerance, the tolerance for each comparing means taken alone being such as to reject a substantial proportion of genuine coins.

2. An apparatus according to claim 1 wherein the array includes a pair of secondary sensors the sensors being spaced along a radius with respect to the coin of the said particular denomination at the test position such that when a coin of the said denomination just occludes one or other of the reference sensors, one of the secondary sensors is occluded by the coin and the other is not occluded by the coin.

3. An apparatus according to claim 1 wherein the two reference sensors lie on a line perpendicular to the coin track and are equidistant from a line drawn parallel to the coin track and approximately half the mean diameter of the predetermined coin above the coin track.

4. An apparatus according to claim 2 wherein the two secondary sensors lie on a line substantially parallel to the coin track.

5. An apparatus according to claim 1 further including means for sensing that the coin is non-circular.

6. An apparatus according to claim 4 including means for sensing that the coin is non-circular, the said sensing means comprising two further sensors, positioned so that when a coin of the said denomination is in the test position, and the coin is just obscuring both of the reference sensors, the coin will not obscure both of the said further sensors, but when a circular coin of a diameter such that it has a chordal dimension corresponding to the chordal dimension for a coin of the said denomination, is at the said test position and the coin is just obscuring both of the reference sensors it will obscure also both of the further sensors, and logic means for providing an indication when the two reference sensors are first concurrently occluded and one or both further sensors is not concurrently occluded.

7. An apparatus according to claim 6 including another sensor positioned substantially on the perpendicular bisector of the reference sensors at a position such that it is not obscured by a circular coin of a diameter such that it has a chordal dimension of a coin of the said denomination when the reference sensors are first concurrently occluded but is obscured by a coin of the said denomination when the reference sensors are first concurrently occluded, and logic means for providing an indication when the two reference sensors are first concurrently occluded and the said another sensor is concurrently occluded.

8. An apparatus according to claim 1 wherein the array includes a pair of secondary sensors positioned with respect to the dimensions of a coin of the particular denomination at the test position such that when a coin of the said denomination just occludes the associated reference sensor, one of the secondary sensors is occluded by the coin and the other is not occluded by the coin.

9. An apparatus according to claim 1 wherein the secondary sensor for the first line and the secondary sensor for the second line are the same sensor.

* * * * *

UNITED STATES PATENT AND TRADEMARK OFFICE

CERTIFICATE OF CORRECTION

PATENT NO. : 4,148,388

DATED : April 10, 1979

INVENTOR(S) : Peter J. Reyner and Patrick A. Henehan

It is certified that error appears in the above-identified patent and that said Letters Patent are hereby corrected as shown below:

Col. 5, claim 6, line 6, "claim 4" should be --claim 3--.

Col. 6, claim 7, line 3, after "dimension" insert

--corresponding to the said chordal dimension--.

Signed and Sealed this

*Eighth* Day of *April 1980*

[SEAL]

*Attest:*

SIDNEY A. DIAMOND

*Attesting Officer*

*Commissioner of Patents and Trademarks*